US008331588B2

(12) United States Patent
Akino

(10) Patent No.: US 8,331,588 B2
(45) Date of Patent: Dec. 11, 2012

(54) RIBBON MICROPHONE UNIT AND RIBBON MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 252 days.

(21) Appl. No.: 12/844,606

(22) Filed: Jul. 27, 2010

(65) Prior Publication Data

US 2011/0038501 A1 Feb. 17, 2011

(30) Foreign Application Priority Data

Aug. 11, 2009 (JP) ..... 2009-186479

(51) Int. Cl.
*H04R 25/00* (2006.01)

(52) U.S. Cl. ..... 381/176

(58) Field of Classification Search ..... 381/176
See application file for complete search history.

(56) References Cited

U.S. PATENT DOCUMENTS 3,636,278 A * 1/1972 Heil ..... 381/163
7,146,019 B2 * 12/2006 Levitsky ..... 381/399
7,174,024 B1 * 2/2007 Suzuki et al. ..... 381/152
2002/0126867 A1 * 9/2002 Aizik ..... 381/399
2006/0023902 A1 * 2/2006 Thigpen ..... 381/176

FOREIGN PATENT DOCUMENTS

JP 2009-105506 5/2009
JP 2009-135630 6/2009

* cited by examiner

*Primary Examiner* — Ramon Barrera
(74) *Attorney, Agent, or Firm* — Whitham Curtis Christofferson & Cook, PC

(57) ABSTRACT

A ribbon microphone unit includes a permanent magnet that forms a magnetic field and a ribbon diaphragm that is disposed in the magnetic field and vibrates upon receiving a sound wave. An elastic layer made of synthetic resin is formed at least at a portion of the ribbon diaphragm, the portion vibrating upon receiving the sound wave. Preferably, the ribbon diaphragm is formed into triangular waves with the portion vibrating upon receiving sound waves being alternately folded along lines in a width direction across the entire length. The elastic layer may be formed on one or both surfaces of the ribbon diaphragm and may be provided only at both side ends of the ribbon diaphragm.

5 Claims, 10 Drawing Sheets

RIBBON MICROPHONE UNIT AND RIBBON MICROPHONE

BACKGROUND OF THE INVENTION

1. Field of the Invention

The present invention relates to a ribbon microphone unit and a ribbon microphone in which damage on a ribbon diaphragm due to impact applied to the ribbon microphone unit and the ribbon microphone during transportation and upon installation is either prevented or reduced.

2. Description of the Related Art

A ribbon microphone mainly includes a pair of magnets for forming a magnetic field and a ribbon diaphragm. The magnets in pair are arranged in parallel at both sides of the ribbon diaphragm while being apart from the ribbon diaphragm for a certain space. The magnets form a magnetic field therebetween in which the ribbon diaphragm is arranged. The ribbon diaphragm is generally formed of an aluminum foil having a thickness of several micrometers. Aluminum is suitable as a material of a ribbon diaphragm of the ribbon microphone because its conductivity is better and its specific gravity is lower as compared with those of other metal materials. The ribbon diaphragm is held at both end portions in the length direction with an appropriate tension applied thereto while being apart from each of the magnets for a certain space. The ribbon diaphragm vibrates in the magnetic field upon receiving sound waves to make a current according to the sound waves flow in the ribbon diaphragm and the sound wave is converted into an electric signal.

FIGS. 5 and 6 illustrate an example of a conventional ribbon microphone unit. In FIGS. 5 and 6, the ribbon microphone unit has a frame 7 having a shape of a rectangular frame that is long in the vertical direction. A pair of permanent magnets 4 is fixed to inside surfaces of the frame 7. The permanent magnets 4 are disposed at respective sides of the frame 7 along the length direction with a certain space therebetween. The permanent magnets 4 are polarized in the width direction (right/left direction in FIG. 5). The polarizing directions of the pair of permanent magnets 4 are the same and a parallel magnetic field is formed between the permanent magnets 4.

A ribbon diaphragm (hereinafter, simply referred to as ribbon) 1 serving both as a diaphragm and a conductive material is disposed inside the parallel magnetic field. The ribbon 1 is an elongated belt-shaped member of which both end portions in the length direction are fixed to respective electrode lead-out portions 18 provided in both end portions in the length direction of the frame 7. The electrode lead-out portions 18 are insulated from the frame 7. Terminal plates 9 are fixed to the respective electrode lead-out portions 18. The end portions 11 of the ribbon 1 are held between the terminal plates 9 and holding members 8 by screwing the holding members 8 into the respective terminal plates 9 with screws 10 in a state where an appropriate tension is applied to the ribbon 1. Thus, the electrode lead-out portions 18 are electrically conductive via the ribbon 1.

The ribbon 1 is formed into triangular waves with the portion other than the end portions 11 corresponding to the electrode lead-out portions 18 alternately folded along lines in a width direction across the entire length at fixed intervals. The direction of the lines formed by the folding, that is, the direction of the lines drawn by the mountains and the valleys of the triangular waves is in the width direction of the ribbon 1. The lines are formed at fixed intervals.

The ribbon 1 vibrates upon receiving sound waves and traverses a magnetic flux between the permanent magnets 4.

The ribbon 1 made of conductive material generates an electric power by traversing the magnetic flux and an electric signal is generated between both ends of the ribbon 1 in the length direction, that is, between the electrode lead-out portions 18. Since the electric signal has a frequency and an amplitude corresponding to those of the vibration of the ribbon 1, the sound wave applied to the ribbon 1 is converted into an electric signal corresponding to the sound wave.

In the ribbon microphone, which is a bidirectional mass control type microphone, the tension applied to the ribbon 1 is very low to set a resonance frequency of the ribbon 1 to a low-band frequency. The low tension is achieved by alternately folding the vibrating portion of the ribbon 1, i.e., the portion of the ribbon 1 other than the end portions 11 along lines in a width direction across the entire length at fixed intervals to form triangular waves as described above.

The ribbon 1, which is applied with low tension by being formed into rectangular waves with its vibrating portion being alternately folded, deforms due to inertia force attributable to the mass of the ribbon when the impact force is applied on the microphone. This leads to the degradation of frequency characteristic and malfunctioning of the microphone. Thus, ribbon microphones need to be improved in this point. FIGS. 7 to 10 explain the mechanism of the deformation. When impact force is applied in the horizontal direction, i.e., the direction parallel to the sound wave receiving surface of the ribbon 1 as shown in FIG. 7, the ribbon 1 deforms in the direction according to the impact force as shown in FIG. 8. The ribbon 1 does not deform if the folded portions indicated by the arrows in FIG. 9, i.e., the mountain portions and the valley portions in the triangular wave, are not unfolded. Folded portions in a conventional ribbon deform because no countermeasures have been taken to prevent the unfolding.

The folded portions of the ribbon 1 deform largely at the side opposite from that to which the impact force is applied and folded portions at either of the left and right sides are extended due to plastic deformation. In other words, the shape of the ribbon 1 becomes unsymmetrical due to the plastic deformation with different stresses applied to the left and the right of the ribbon 1. Once this happens, the ribbon 1 cannot return to its original shape and the resonance frequency is shifted to degrade the frequency characteristics. The ribbon 1 deformed over a certain level may be in contact with the permanent magnet 4 that is supposed to face the ribbon 1 with a certain space therebetween. This degrades the frequency characteristics and may cause malfunctioning of the whole system.

A ribbon microphone is transported, for example, while being incorporated in a box filled with and surrounded by a cushion to prevent an impact force from being directly applied to the microphone. However, no countermeasure has been taken for an impact force applied at a situation other than transportation such as a case where the ribbon microphone is accidentally dropped upon being mounted on a microphone stand upon installation.

The inventor has filed various patent applications related to a ribbon microphone unit, a ribbon microphone, and a method for manufacturing a ribbon for a ribbon microphone, part of which are disclosed in Japanese Patent Application Publication 2009-135630 and Japanese Patent Application Publication 2009-105506. The inventions disclosed in Japanese Patent Application Publication 2009-135630 and Japanese Patent Application Publication 2009-105506 are relatively similar to the present invention.

However, no countermeasures for effectively reducing the damage caused on the ribbon due to impact force is included in the inventions disclosed in Japanese Patent Application Publication 2009-135630 and Japanese Patent Application Publication 2009-105506.

SUMMARY OF THE INVENTION

The present invention is made in view of the above described problems of the conventional technique and an object of the present invention is to provide a ribbon microphone unit and a ribbon microphone that can reduce or eliminate, the damage caused on a ribbon thereof due to an impact force applied thereto during transportation and upon installation.

An embodiment of the present invention is a ribbon microphone unit including a permanent magnet that forms a magnetic field and a ribbon diaphragm that is disposed in the magnetic field and vibrates upon receiving a sound wave. An elastic layer made of synthetic resin is formed at least at a portion of the ribbon diaphragm, the portion vibrating upon receiving the sound wave.

The ribbon diaphragm may be formed into triangular waves with the portion of the ribbon diaphragm vibrating upon receiving sound waves being alternately folded along lines in a width direction across entire length.

The elastic layer may be formed on one or both surfaces of the ribbon diaphragm and may be provided only at both side ends of the ribbon diaphragm.

The elastic layer is provided at least at the portion of the ribbon diaphragm, the portion vibrating upon receiving sound waves. Thus, the force applied to the ribbon diaphragm leading to the deformation of the ribbon microphone is countered by the elastic restoring force of the elastic layer. Accordingly, the ribbon diaphragm is prevented from deforming, whereby degradation of the frequency characteristics of the microphone incorporating the ribbon diaphragm due to impact force is prevented.

DETAILED DESCRIPTION OF THE PREFERRED EMBODIMENTS

Figure 1:
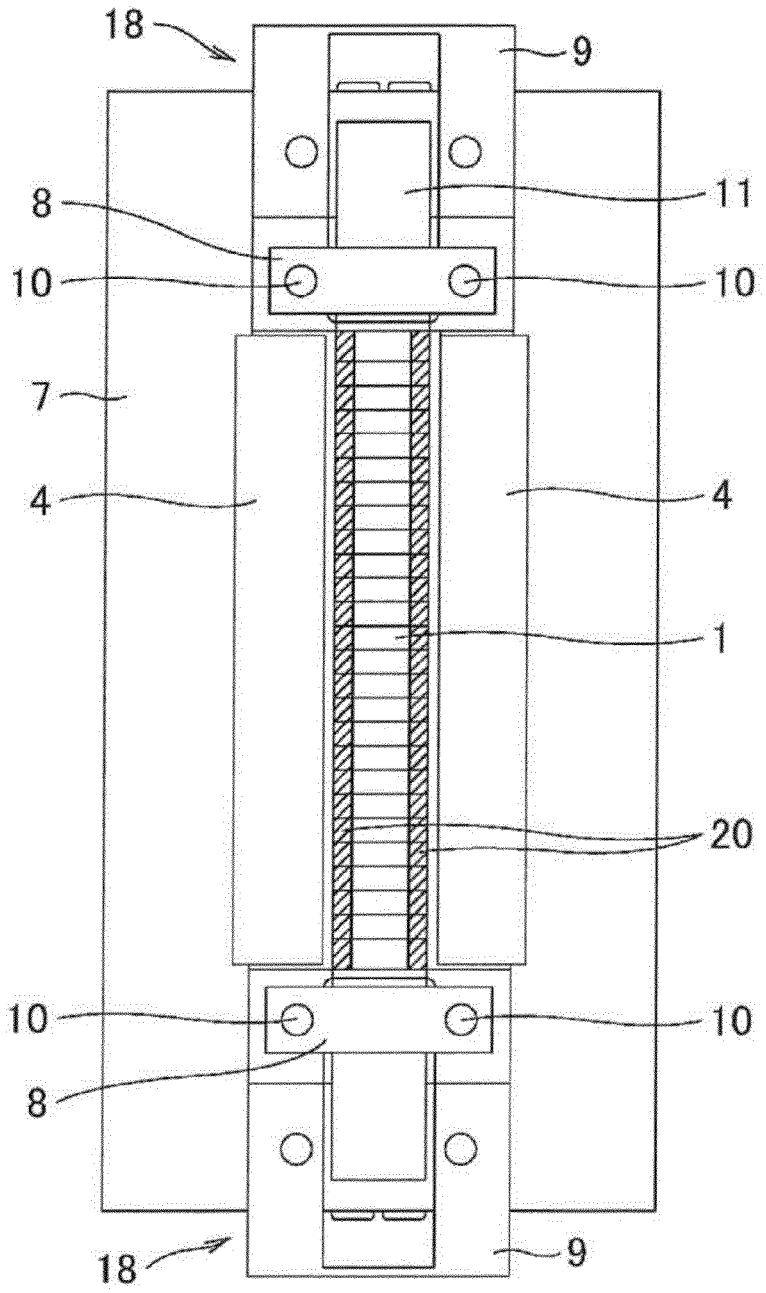
FIG. 1 is a front view of an embodiment of a ribbon microphone unit according to the present invention.

An embodiment of a ribbon microphone unit and a ribbon microphone according to the present invention is described with reference to FIGS. 1 to 4. The feature of the present invention lies in a structure of the ribbon diaphragm (hereinafter, simply referred to as ribbon). Since the embodiment of the present invention has major part of the structure identical to that of the conventional example, the identical elements are given the same reference numerals.

Figure 2:
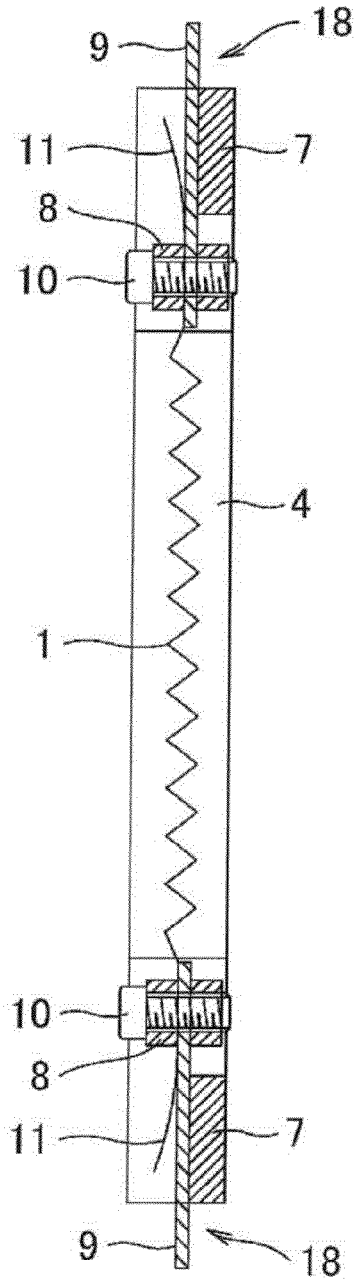
FIG. 2 is a longitudinal sectional view of the embodiment.

In FIGS. 1 and 2, the ribbon microphone unit has a frame 7 having a shape of a rectangular frame that is long in the vertical direction. A pair of permanent magnets 4 is fixed to inside surfaces of the frame 7. The permanent magnets 4 are disposed at respective sides of the frame 7 along the length direction with a certain space therebetween. The permanent magnets 4 are polarized in the width direction (right/left direction in FIG. 1). The polarizing directions of the pair of permanent magnets 4 are the same and a parallel magnetic field is formed between the permanent magnets 4.

A ribbon diaphragm 1 serving both as a diaphragm and a conductive material is disposed inside the parallel magnetic field. The ribbon 1 is an elongated belt-shaped member of which both end portions in the length direction are fixed to respective electrode lead-out portions 18 provided in both end portions in the length direction of the frame 7. The electrode lead-out portions 18 are insulated from the frame 7. Terminal plates 9 are fixed to the respective electrode lead-out portions 18. The end portions 11 of the ribbon 1 are held between the terminal plates 9 and holding members 8 by screwing the holding members 8 into the respective terminal plates 9 with screws 10 in a state where an appropriate tension is applied to the ribbon 1. Thus, the ribbon 1 is supported by the frame 1 and the electrode lead-out portions 18 are electrically conductive via the ribbon 1.

The ribbon 1 is formed into triangular waves with the portion other than the end portions 11 corresponding to the electrode lead-out portions 18 alternately folded along lines in a width direction across the entire length at fixed intervals. The direction of the lines formed by the folding, that is, the direction of the lines drawn by the mountains and the valleys of the triangular waves is in the width direction of the ribbon 1. The lines are formed at fixed intervals across the length direction of the ribbon 1.

The ribbon 1 vibrates upon receiving sound waves and traverses a magnetic flux between the permanent magnets 4. The ribbon 1 made of conductive material generates an electric power by traversing the magnetic flux and an electric signal is generated between both ends of the ribbon 1 in the length direction, that is, between the electrode lead-out portions 18. The electric signal has a frequency and an amplitude corresponding to those of the vibration of the ribbon 1. Accordingly, the sound wave applied to the ribbon 1 is converted into an electric signal corresponding to the sound wave and the electric signal is output from the electrode lead-out portions 18.

In the ribbon microphone, which is a bidirectional mass control type microphone, the tension applied to the ribbon 1 is very low to make a resonance frequency of the ribbon 1 as low as possible. The low tension is achieved by alternately folding the vibrating portion of the ribbon 1, i.e., the portion of the ribbon 1 other than the end portions 11 along lines in a width direction across the entire length at fixed intervals to form triangular waves as described above.

Figure 3:
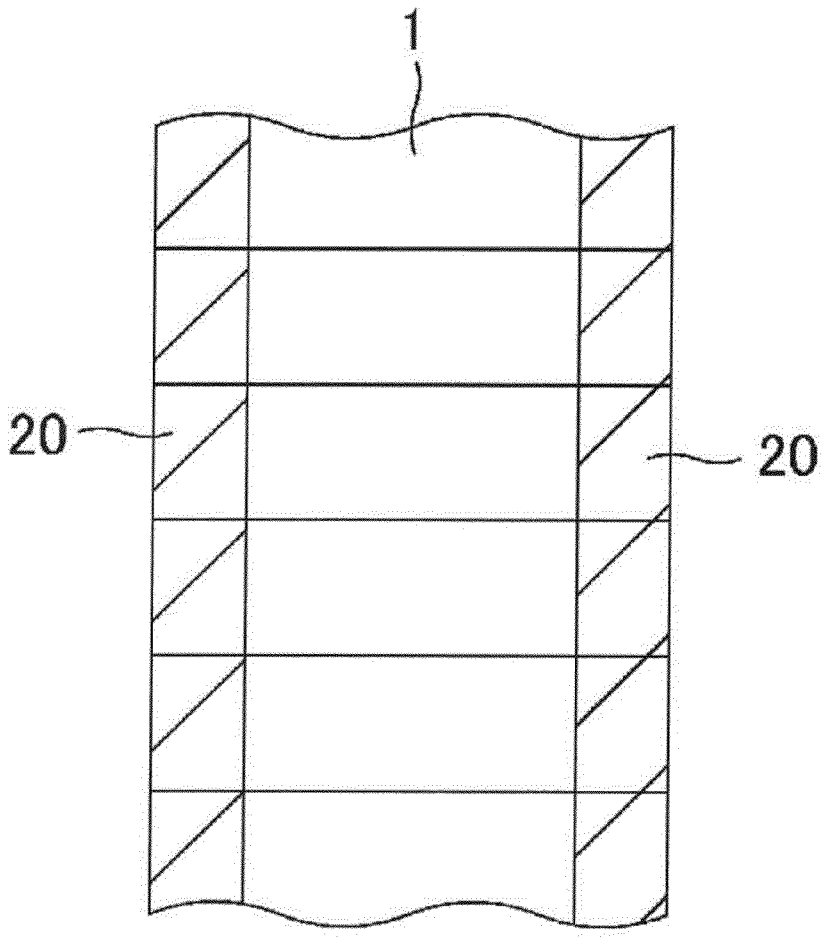
FIG. 3 is a partially enlarged front view of a ribbon diaphragm of the embodiment.
Figure 4:
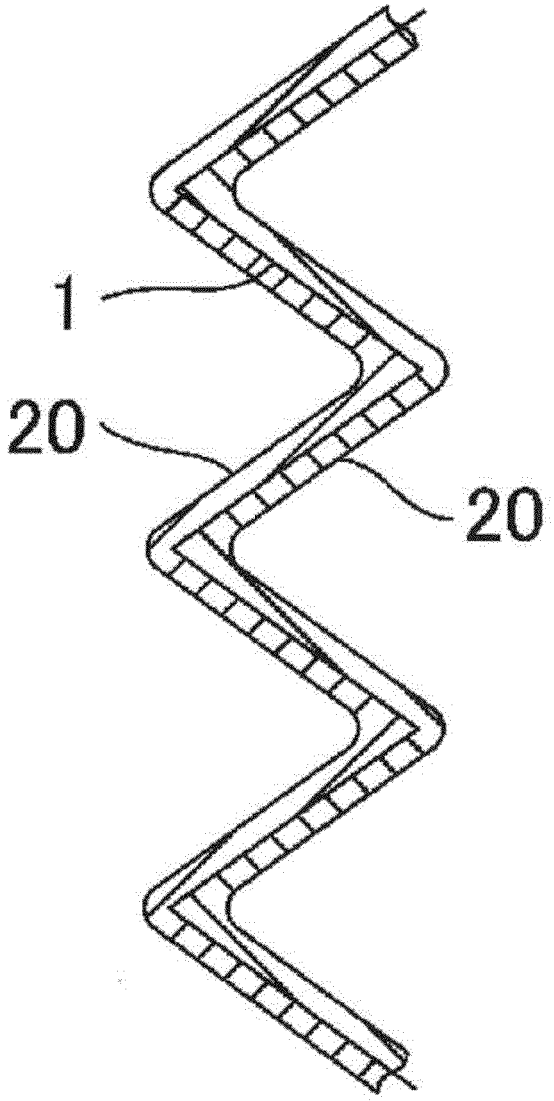
FIG. 4 is a partially enlarged longitudinal sectional view of the ribbon diaphragm.
Figure 5:
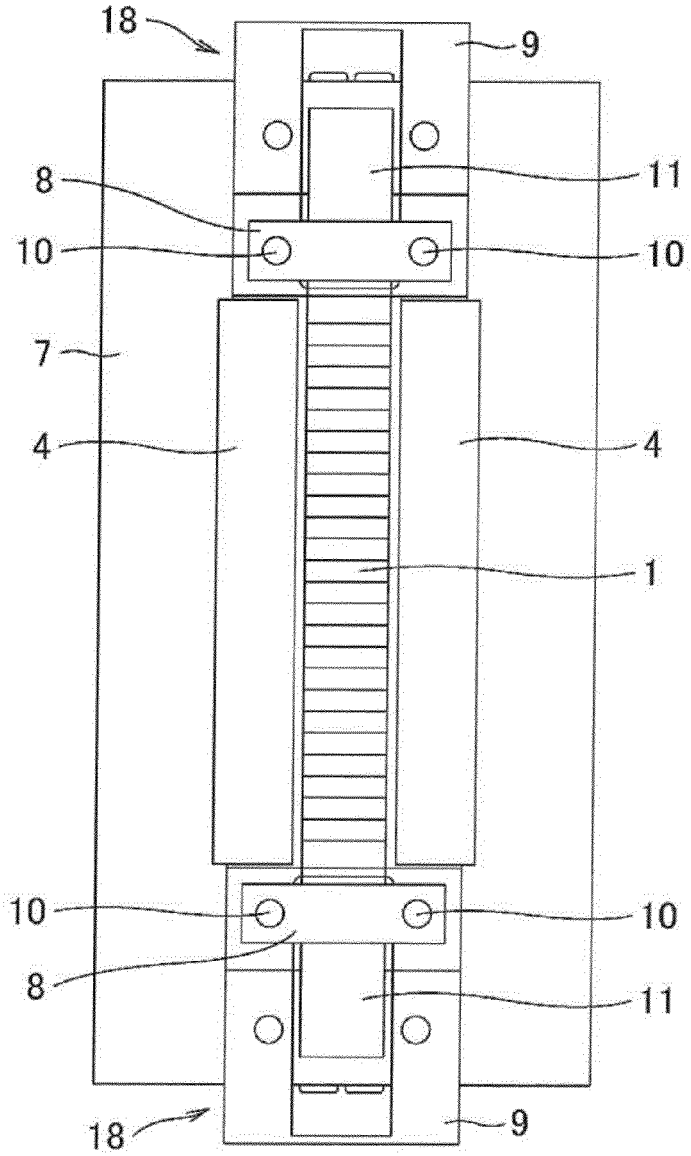
RELATED ART FIG. 5
FIG. 5 is a front view of a conventional example of a ribbon microphone unit.
Figure 6:
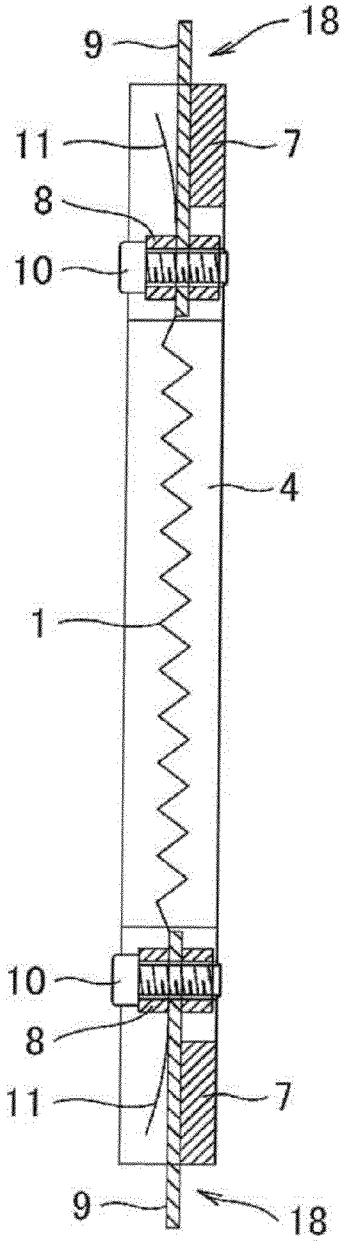
RELATED ART FIG. 6
FIG. 6 is a longitudinal sectional view of the conventional example.
Figure 7:
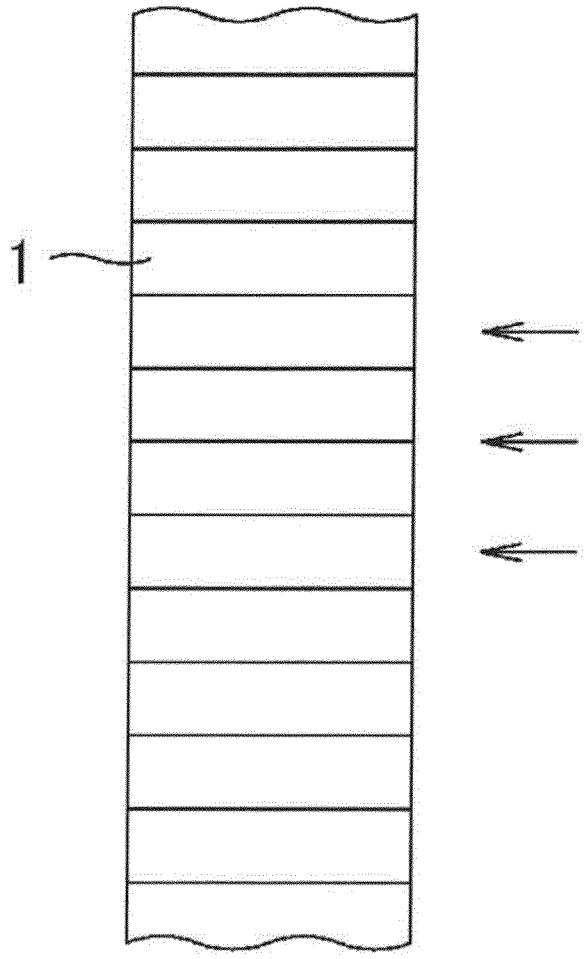
RELATED ART FIG. 7
FIG. 7 is a front view illustrating a part of a ribbon diaphragm in the conventional example.
Figure 8:
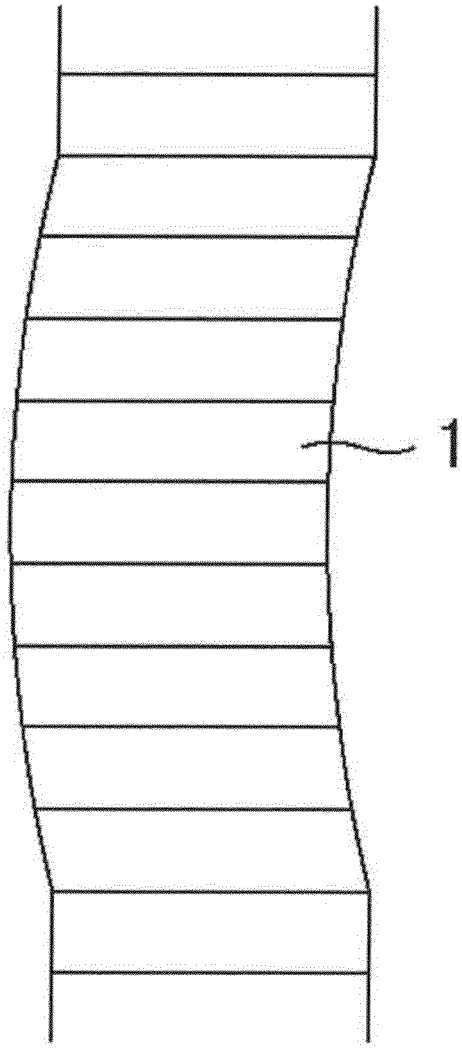
RELATED ART FIG. 8
FIG. 8 is a front view illustrating the ribbon diaphragm in the conventional example in a deformed state with a pressure force applied thereto in a lateral direction.
Figure 9:
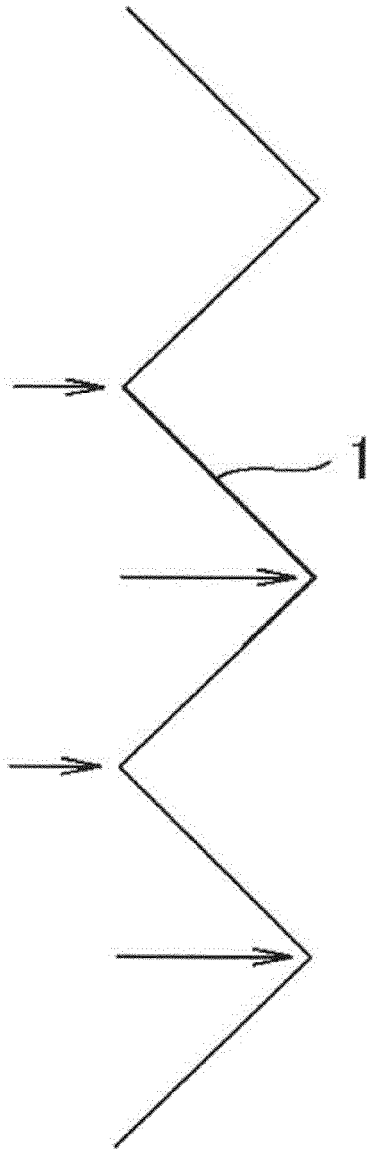
RELATED ART FIG. 9
FIG. 9 is an enlarged longitudinal sectional view indicating the portions that deform by an impact force applied to the ribbon diaphragm in the conventional example.
Figure 10:
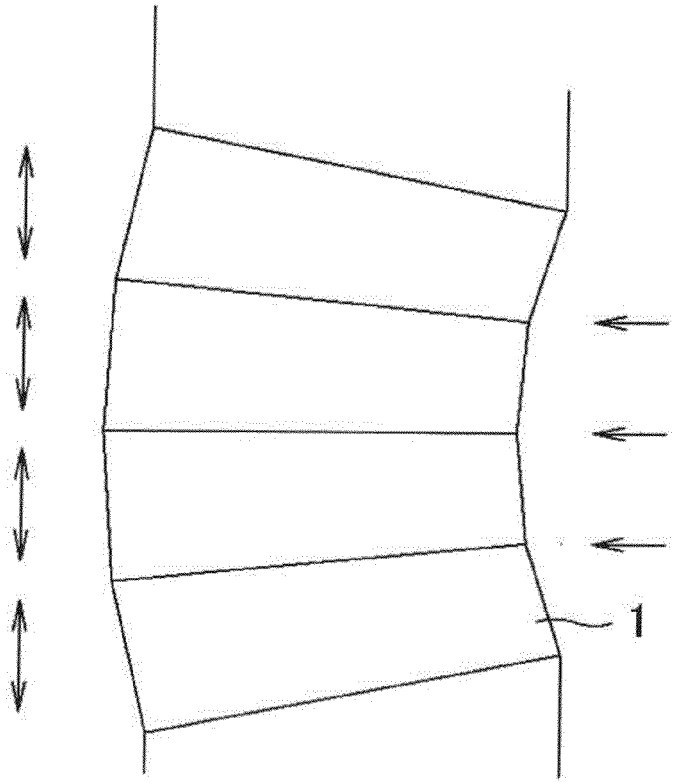
RELATED ART FIG. 10
FIG. 10 is a front view specifically illustrating the deformation of the ribbon diaphragm in the conventional example due to the impact force applied in the lateral direction.

Therefore, the ribbon 1 easily deforms due to the impact force as described above if no countermeasures are taken. In the present embodiment, elastic layers 20 made of synthetic resin are provided at least at a portion of the ribbon 1 that vibrates upon receiving sound waves. In the embodiment, as shown in FIGS. 1, 3, and 4, the elastic layers 20 are provided only at the left and the right side ends of the ribbon 1. Specifically, the elastic layers 20 are continuously formed in the length direction of the ribbon 1 along both side ends of the ribbon 1 in the width direction, and the elastic layers 20 sandwich the ribbon 1 by being provided on both surfaces thereof.

With the structure of the ribbon 1 used in the embodiment, the impact force applied in a direction parallel to the surface that receives sound waves to unfold the folded portions formed at fixed intervals is countered by the elastic restoring force of the elastic layers 20. Accordingly, plastic deformation of the ribbon 1 is prevented. Therefore, the frequency characteristic degradation of the microphone due to deformation of the ribbon 1 is prevented. Furthermore, malfunctioning of the microphone due to the contact between the ribbon 1 and the permanent magnet 4 arranged nearby is prevented.

The ribbon 1 is made of an aluminum foil and the elastic layer 20 is made of a polyester layer. Since the ribbon microphone is a mass control type microphones as described above, the ribbon microphone unit should be light as possible and thus, increase in the mass of the ribbon diaphragm by providing the elastic layer 20 should be minimized as possible. Therefore, the elastic layer 20 is made of polyester having relatively low specific gravity. Specifically, polyester has a specific gravity of 1.38 while aluminum has a specific gravity of 2.71. Naturally, a portion at which the elastic layer 20 is formed should have smallest possible area for providing the desired effect. Therefore, in the present embodiment, the elastic layers 20 are formed along respective side ends in the width direction of the ribbon 1 and are continuously formed in the length direction of the ribbon 1. All things considered, the ribbon 1 can be protected from deformation as described later with a slight increase in the mass.

The invention disclosed in Japanese Patent Application Publication 2009-135630 discloses a ribbon in a ribbon microphone, the ribbon having folded portions to be formed into triangular waves progressing in a direction perpendicular to that in the embodiment illustrated in FIG. 1. In other words, the ribbon is alternately folded along lines in the length direction of the ribbon to form first triangular waves progressing in the width direction of the ribbon. Such a folding for forming the first triangular waves can improve the rigidity of the ribbon, but makes it difficult for the ribbon to vibrate upon receiving sound waves. Therefore, the ribbon disclosed in Japanese Patent Application Publication 2009-135630 is provided with second triangular waves progressing in the direction perpendicular to that of the first triangular wave, i.e., second triangular waves progressing in the same direction as that in the embodiment illustrated in FIG. 1, at both sides of the first triangular wave, that is, both ends of the ribbon in the length direction.

The present invention can be applied to the above described ribbon disclosed in Japanese Patent Application Publication 2009-135630 as well as to a ribbon having any kind of shape.

The above described object of the present invention can be achieved by forming the elastic layer on at least one of the surfaces of the ribbon diaphragm 1.

A ribbon microphone can be obtained by providing the ribbon microphone unit illustrated in FIGS. 1 and 2 in a microphone casing and providing the ribbon microphone unit with a connector enabling the connection to the exterior.

The ribbon microphone unit and the ribbon microphone according to the present invention are suitable for a use in a studio but are not limited to a specific use. The ribbon microphone unit and the ribbon microphone according to the present invention, which have excellent acoustic characteristics and unique sound quality, are expected to be in high demand.

What is claimed is:

1. A ribbon microphone unit comprising:

a permanent magnet that forms a magnetic field; and a ribbon diaphragm that is disposed in the magnetic field and vibrates upon receiving a sound wave, said ribbon diaphragm having opposing ends in a length direction and opposing side ends in a width direction, wherein an elastic layer made of synthetic resin is formed at least at a portion of the ribbon diaphragm, the portion vibrating upon receiving the sound wave, the elastic layer is formed only along both side ends of the portion of the ribbon diaphragm in the width direction, and the portion of the ribbon diaphragm vibrating upon receiving the sound wave is formed into triangular waves by being alternately folded along lines in a width direction across its entire length.

2. The ribbon microphone unit according to claim 1, wherein the elastic layer is formed on one surface of the ribbon diaphragm.

3. The ribbon microphone unit according to claim 1, wherein the elastic layer is formed on both surfaces of the ribbon diaphragm.

4. The ribbon microphone unit according to claim 1, wherein the ribbon diaphragm is formed of an aluminum foil and the elastic layer formed on the ribbon diaphragm is made of polyester.

5. A ribbon microphone comprising:

a microphone casing; and a ribbon microphone unit incorporated in the microphone casing, wherein the ribbon microphone unit comprises a permanent magnet that forms a magnetic field; and a ribbon diaphragm that is disposed in the magnetic field and vibrates upon receiving a sound wave, wherein an elastic layer made of synthetic resin is formed at least at a portion of the ribbon diaphragm, the portion vibrating upon receiving the sound wave, the elastic layer is formed only along both side ends of the portion of the ribbon diaphragm in a width direction, and the portion of the ribbon diaphragm vibrating upon receiving the sound wave is formed into triangular waves by being alternately folded along lines in a width direction across its entire length.

* * * * *